United States Patent [19]

Lockard

[11] Patent Number: 4,737,117

[45] Date of Patent: Apr. 12, 1988

[54] DOUBLE-ROW ELECTRICAL CONNECTOR AND METHOD OF MAKING SAME

[75] Inventor: Joseph L. Lockard, Harrisburg, Pa.

[73] Assignee: AMP Incorporated, Harrisburg, Pa.

[21] Appl. No.: 32,921

[22] Filed: Mar. 30, 1987

Related U.S. Application Data

[63] Continuation of Ser. No. 754,785, Jul. 12, 1985, abandoned, which is a continuation-in-part of Ser. No. 536,017, Sep. 26, 1983, Pat. No. 4,602,831, which is a continuation-in-part of Ser. No. 442,472, Nov. 17, 1982, abandoned.

[51] Int. Cl.[4] ..... H01R 4/66; H01R 13/58

[52] U.S. Cl. ..... 439/92; 439/449

[58] Field of Search ..... 439/77, 92, 93, 445, 439/446, 447, 448, 492, 493, 494, 495, 496, 497, 498, 499, 578, 579, 580, 581, 582, 583, 584, 585, 656, 657, 660, 682, 686, 736, 874, 877, 604, 606, 449, 452, 460, 470, 471

[56] References Cited

U.S. PATENT DOCUMENTS

| | | | |
|---|---|---|---|
| 3,086,251 | 4/1963 | Bernat | 339/196 M |
| 3,569,900 | 3/1971 | Uberbacker | 339/107 |
| 3,634,806 | 1/1972 | Fergusson | 439/497 |
| 3,731,251 | 5/1973 | Sinclair | 339/103 M |
| 3,854,787 | 12/1974 | Snyder, Jr. | 439/469 |
| 3,864,010 | 2/1975 | Wasserlein, Jr. | 339/107 |
| 3,878,318 | 4/1975 | Ziegler, Jr. et al. | 339/276 R |
| 4,043,630 | 8/1977 | Suverison et al. | 339/102 R |
| 4,173,388 | 11/1979 | Brandeau | 339/276 T |
| 4,252,397 | 2/1981 | Eigenbrode et al. | 339/99 R |
| 4,260,209 | 4/1981 | Zell et al. | 439/443 |
| 4,269,466 | 5/1981 | Huber | 439/467 |
| 4,310,208 | 1/1982 | Webster et al. | 339/14 R |
| 4,352,531 | 10/1982 | Gutter | 339/14 R |
| 4,451,099 | 5/1984 | Bricker, Jr. et al. | 339/14 R |
| 4,579,404 | 4/1986 | Lockard | 439/736 |
| 4,596,432 | 6/1986 | Tighe, Jr. | 439/580 |
| 4,602,830 | 7/1986 | Lockard | 439/736 |
| 4,602,831 | 7/1986 | Lockard | 439/108 |
| 4,605,276 | 8/1986 | Hasircoglu | 339/176 MF |

FOREIGN PATENT DOCUMENTS

| | | |
|---|---|---|
| 0023936 | 2/1981 | European Pat. Off. . |
| 0147080 | 11/1984 | European Pat. Off. . |

*Primary Examiner*—Gil Weidenfeld
*Assistant Examiner*—Gary F. Paumen
*Attorney, Agent, or Firm*—Anton P. Ness

[57] ABSTRACT

An electrical connector comprises a forward housing member, signal and ground terminals and dielectric cover means over the terminations of signal and ground conductors to the terminals, for two-lead or three-lead individual cables or ribbon cable. Contact sections of the terminals are secured in passageways of a contact-receiving portion of the forward housing member, and rearward sections of the terminals have respective signal and ground conductors of electrical cable or cables laser welded thereto. The rearward terminal sections are disposed along a contact-carrying portion of the forward housing member extending rearwardly from the contact-receiving portion. A dielectric cover means is molded over the contact-carrying portion, the rearward terminal sections, the terminations, the signal and ground conductors and end portions of the electrical cable or cables thus sealing the terminations, holding the terminals immobile and providing support and non-deforming strain relief for the cable or cables. An integral transverse bar spaced rearwardly from the cover means provides second strain relief for the cables when a plurality of cables are used, and spaces and supports them. A method for the overmoulding is disclosed where core pins hold the terminals to the contact-carrying portion and in place therealong, just rearwardly of the passageways, and simultaneously close up the rearward end of the passageways.

12 Claims, 6 Drawing Sheets

30
28
26
16
14
44
50
24
50
36A
36B
34
38
46
42
40
52
12
54
56
22A
22B 18
64
60
62
66
78
36A
36B
28
30
14
16
44
40
12
22A
22B

DOUBLE-ROW ELECTRICAL CONNECTOR AND METHOD OF MAKING SAME

CROSS REFERENCE TO RELATED APPLICATIONS

This application is a continuation of application Serial No. 754,785 filed July 12, 1985, which was a continuation-in-part application of U.S. patent application Ser. No. 536,017 filed Sept. 26, 1983, now abandoned and continued as Ser. No. 769,552 filed Aug. 26, 1985, now U.S. Pat. No. 4,602,831; U.S. patent application Ser. No. 536,017 was a continuation-in-part application of U.S. patent application Ser. No. 442,472 filed Nov. 17, 1982, now abandoned, a continuation application of which was filed as U.S. patent application Ser. No. 670,662 filed Nov. 13, 1984, now abandoned.

FIELD OF THE INVENTION

The present invention relates to the field of electrical connectors and more particularly to the field of double row connectors for transmission cables.

BACKGROUND OF THE INVENTION

Double row receptacle connectors are known for flat transmission cable, which comprise a connector assembly for mating with a two-row pin array. Such connector assemblies route adjacent closely spaced signal conductors of the flat cable to terminals on alternating sides of the connector while routing the respective ground conductors to a ground bus contained in the connector.

U.S. Pat. No. 4,260,209 discloses such a connector for providing mass termination of a flat transmission cable, where the receptacle terminals for the signal conductors have slotted beam termination sections and are terminated to the conductors by insulation displacement. Similarly the ground conductors are secured in slotted beams of the ground bus. The receptacle contacts and ground bus are disposed along respective recesses of a housing, the conductors of the cable are terminated thereto, a cover is placed over the terminations, and a strain relief member is secured to the assembly. The connector provides for selective programming of ground terminals by connecting selected receptacle terminals to the ground bus instead of signal conductors, by grounding bars or by sacrificed signal conductors.

U.S. Pat. No. 4,269,466 discloses another double row receptacle connector for flat transmission cable wherein the terminals are disposed in channels along opposing sides of a housing member and respective signal conductors are terminated by insulation displacement to slotted beam termination sections. Cover members are placed against the sides of the housing, locking to the housing at its forward end and to each other at the rearward end providing cable strain relief. A ground bus bar engages the ground conductors by a plurality of slotted beam termination sections. To selectively program the ground terminals of the connector, the ground bus bar can have selectively positioned termination sections to engage sacrificed signal conductors by insulation displacement which signal conductors then proceed forwardly to engage respective receptacle contacts which become ground terminals. U.S. Pat. Nos. 4,602,831 and 4,682,840, both assigned to the assignee hereof, disclose an electrical connector for individual transmission cables with minimized impedance discontinuities. The connector provides a row of plug contact sections extending forwardly from a dielectric contact-carrying member on one side of which are secured signal contacts terminated to signal conductors, and on the other side of which is secured a ground plane to which are terminated the ground conductors. An insulative cover is overmolded therearound which seals the terminations which are preferably laser welded, and also extends along the cables providing strain relief. Contact sections extend forwardly from the ground plane at selected locations aligned with the signal contact sections.

It is desirable to provide a double row receptacle connector for individual signal transmission cables.

It is also desirable to provide such a connector for transmission of signals with high speed and high reliability by providing for minimized impedance discontinuities.

It is even further desirable to provide such a connector having a dielectric cover which seals the conductor/terminal connections and the adjacent lengths of insulated conductor cables, holds the terminals immobile, provides strain relief for the cables without deforming them, and when individual cables are used provides spacing and support therefor.

SUMMARY OF THE INVENTION

The present invention is a double row receptacle connector for high speed signal transmission cables for mating with a pin array. The connector includes a premolded forward housing member having a contact-receiving portion and a contact-carrying portion extending rearwardly from the medial plane of the contact-receiving portion. Two rows of terminal-receiving passageways extend rearwardly from the mating face of the forward housing member through the contact-receiving portion of the housing; channels extend along the top and bottom surfaces of the contact-carrying portion of the housing aligned with the passageways.

Receptacle contact terminals are first secured in the housing with their contact sections secured in the passageways and body sections and termination sections disposed along the channels rearwardly therefrom, with the signal terminals alternating with ground terminals within each row. Each signal terminal is opposed by a ground terminal in the opposing row, to which are respectively terminated the signal conductor and the one or two ground conductors associated therewith, of a respective transmission cable. The signal conductor is preferably disposed along and held by interference fit within a slotted termination section of the signal terminal and then connected thereto by laser welding. The one or two ground conductors are similarly disposed along and held by interference fit within a slotted termination section of the ground terminal and then laser welded thereto. The transmission cables are arranged in a single row extending rearwardly from the housing member in the medial plane of the housing's contact-carrying portion. Ribbon cable may also be used with the present invention.

Rearwardly of the contact-receiving portion of the housing, moldable dielectric material is then molded sealingly over the contact-carrying portion and the conductor/terminal terminations and along insulated portions of the transmission cable for strain relief, forming a dielectric cover means which seals the terminations and holds the terminals immobile. When individual cables are used, preferably a transverse second strain relief is formed during the molding of the cover means and spaced rearwardly along the transmission cables a selected distance from the cover means, with longitudinally extending web section at each end of the row of cables integrally joining the second strain relief and the cover means.

The strain relief provided by the present invention does not deform the transmission cables, like other conventional strain relief methods. The providing of alternating and opposing signal and ground terminals minimizes impedance problems. The terminations are by high integrity laser welding and are sealed thereafter.

A plurality of double row connectors of the present invention can be placed side by side, each having a low profile to electrically mate with a multi-row pin array of a printed circuit board, or they can be placed end-to-end to mate a long double row of pins. The double row connector of the present invention may be used with a variety of transmission cables.

DETAILED DESCRIPTION OF THE PREFERRED EMBODIMENT

Figure 1:
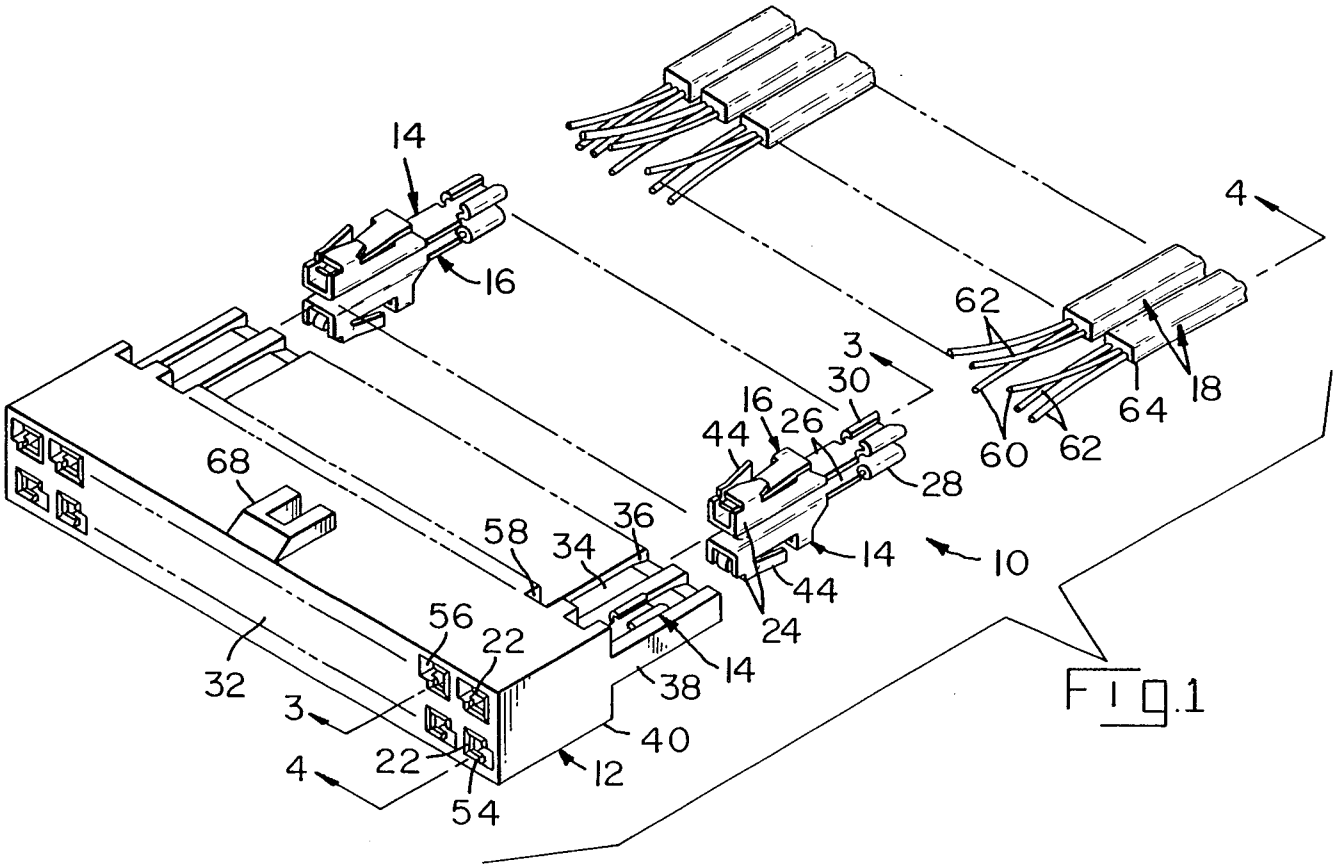
FIG. 1 is a perspective view of the connector assembly of the invention, with the terminals exploded from the housing and the prepared transmission cables exploded from the terminals, prior to termination assembly and overmolding.
Figure 2:
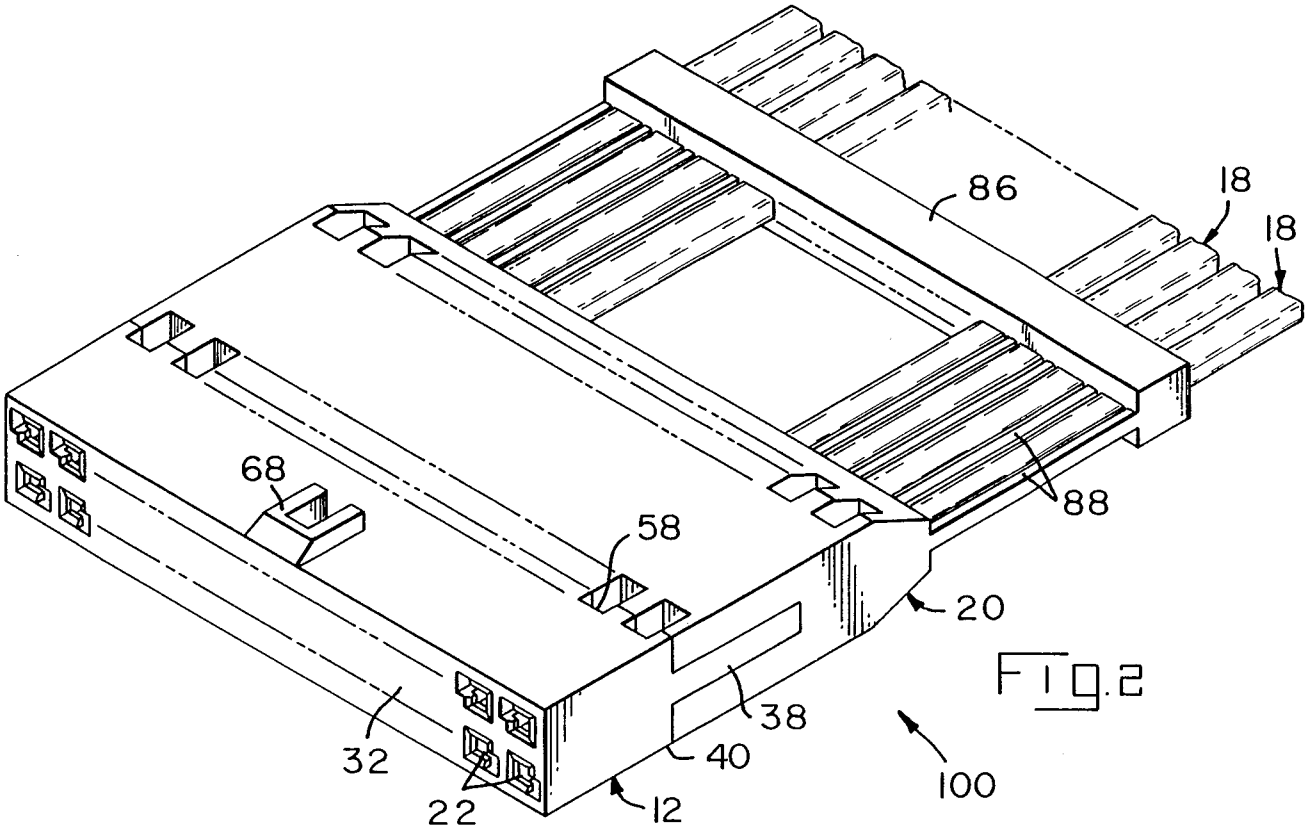
FIG. 2 is a perspective view of the assembled connector assembly of FIG. 1 after overmolding.

FIG. 1 illustrates the components comprising the terminal subassembly 10 of the present invention, including a premolded dielectric forward housing 12, receptacle signal terminals 14, receptacle ground terminals 16, and transmission cables 18 with a signal 14 and an opposing ground 16 terminal associated with each cable 18. FIG. 2 shows the completed connector assembly 100 of the present invention after the dielectric moldable material is overmolded into an insulative, sealing cover means 20 over the terminal subassembly 10 of FIG. 1 after the terminals 14, 16 have been secured in passageways 22 of housing 12 and respective conductors of cables 18 terminated to terminals 14, 16. Housing 12 may have a keying feature 68 for proper mating with a pin shroud (not shown) on the printed circuit board surrounding the pin array to which connector assembly 100 is to be mated.

Figures 3, 4:
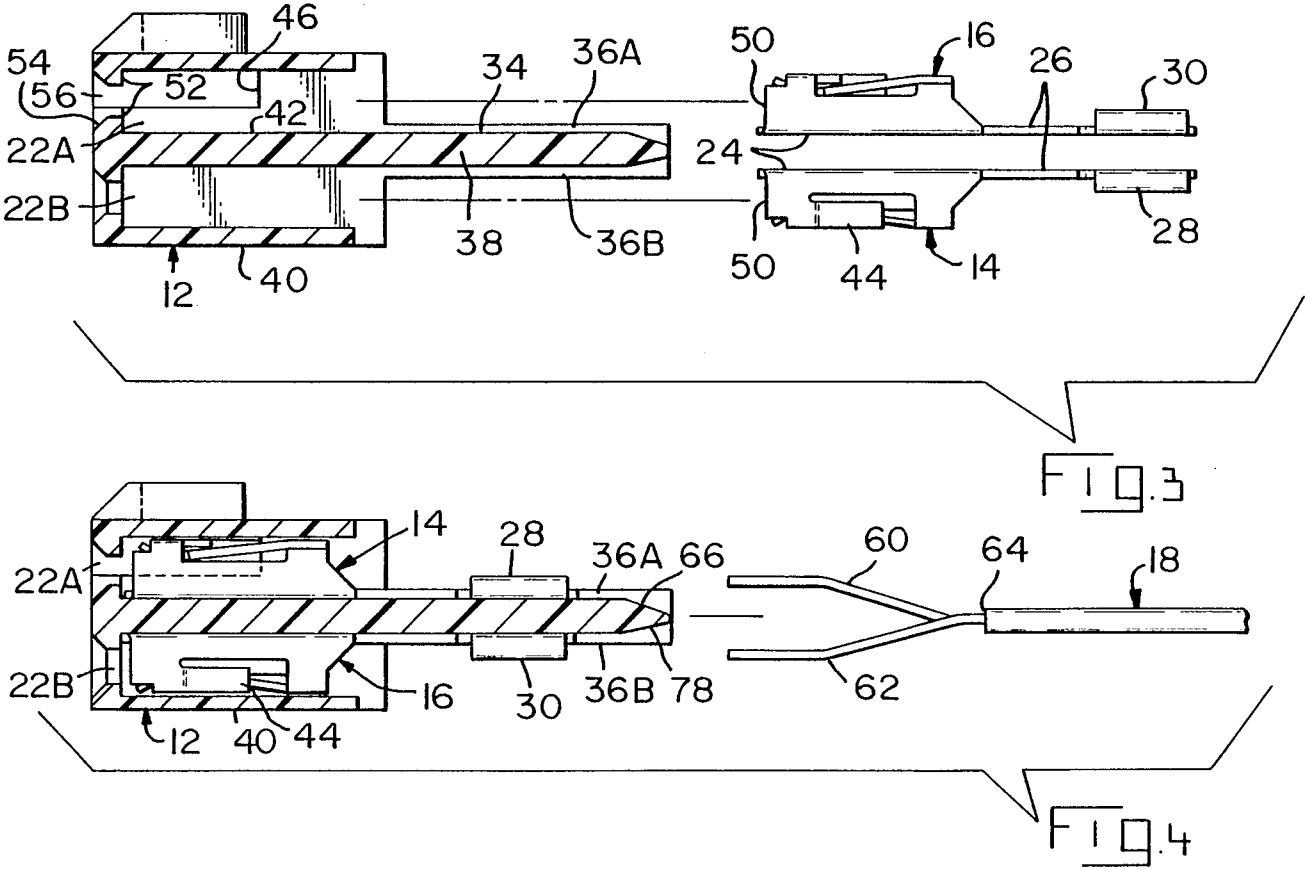
FIG. 3 is a longitudinal section view of the housing and terminals taken along line 3—3 of FIG. 1.
FIG. 4 is a longitudinal section view of the terminals in the housing and the cable conductors to be terminated thereto, taken along line 4—4 of FIG. 1.

In FIGS. 1 and 3, receptacle terminals 14, 16 are stamped and formed preferably of Copper Alloy 725 and have identical box-type contact sections 24, identical planar body sections 26 and similar conductor-connecting sections 28, 30 respectively. Contact sections 24 are received in terminal-receiving passageways 22 of housing 12 which communicate with and extend rearwardly from mating face 32 thereof. Planar body sections 26 are disposed along bottom surfaces 34 of channels 36 in contact-carrying portion 38, which is integral with housing 12 and extends rearwardly from contact-receiving portion 40 thereof. Bottom channel surfaces 34 each extend continuously rearwardly from inside wall 42 of a respective passageway 22, best seen in FIG. 3.

Receptacle terminals 14, 16 are secured in respective passageways 22 by means of locking lances 44 on contact sections 24 which extend rearwardly and outwardly therefrom at a selected angular location. Upon full insertion of a terminal 14, 16 is locking lance 44 engages a forwardly facing stop surface 46 along a respective selected passageway sidewall 48, as shown best in FIGS. 7 and 8, to prevent axially rearward movement of terminal 14, 16. Forward end 50 of terminal 14, 16 engages rearwardly facing stop surfaces 52 of passageway 22 proximate its forward end 54 to prevent further axially forward movement of terminal 14, 16. Forward passageway end 54 is beveled to provide a lead-in for insertion of a respective square pin (not shown) of a pin array such as on a printed circuit board, which pin is electrically matable with a respective receptacle signal terminal 14 or ground terminal 16. A recess 56 is molded along selected passageway sidewall 48 forward of stop surface 46 both to facilitate molding of stop surface 46 and to receive a tool to unlatch locking lance 44 of a terminal 14, 16 should it be desirable to remove the terminal during assembly. At the rearward end of each passageway 22 is a rear recess 58 for receiving a mold core pin, discussed later.

Signal terminals 14 and ground terminals 16 are alternated along each row during insertion of the terminals in passageways 22 of housing 12, with a signal terminal 14 of one row opposing a ground terminal 16 of the other row. Each pair of signal terminals 14 and ground terminals 16 is associated with each transmission cable 18. Each cable 18 has a signal conductor 60 and two ground conductors 62, one on each side of the signal conductor and spaced therefrom, with an insulative outer jacket 64 therearound having a rectangular cross-section. Each cable 18 is prepared for termination by its outer jacket 64 being stripped from an end portion to expose the signal 60 and ground 62 conductors.

Figure 5:
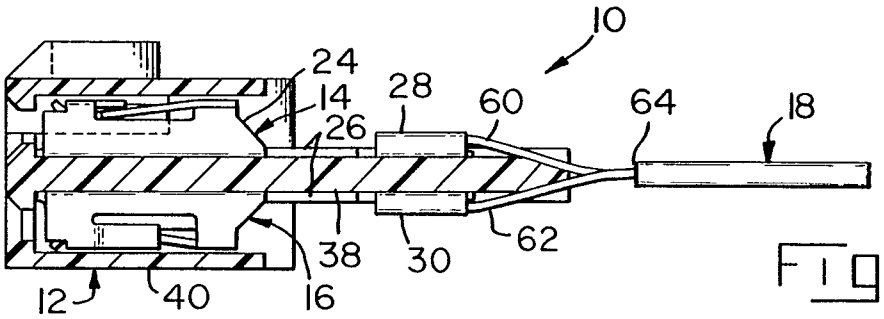
FIG. 5 shows the conductors terminated to the housed terminals of FIG. 4.
Figure 6:
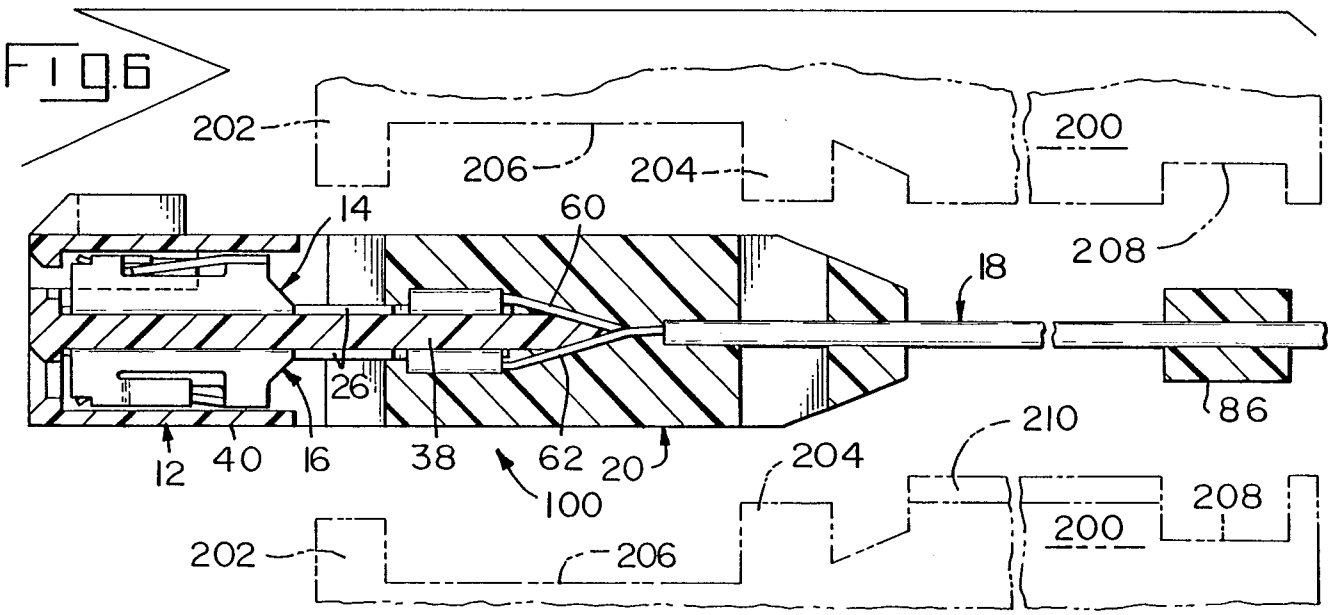
FIG. 6 shows the terminated subassembly of FIG. 5 after overmolding, with the mold shown in phantom.
Figure 9:
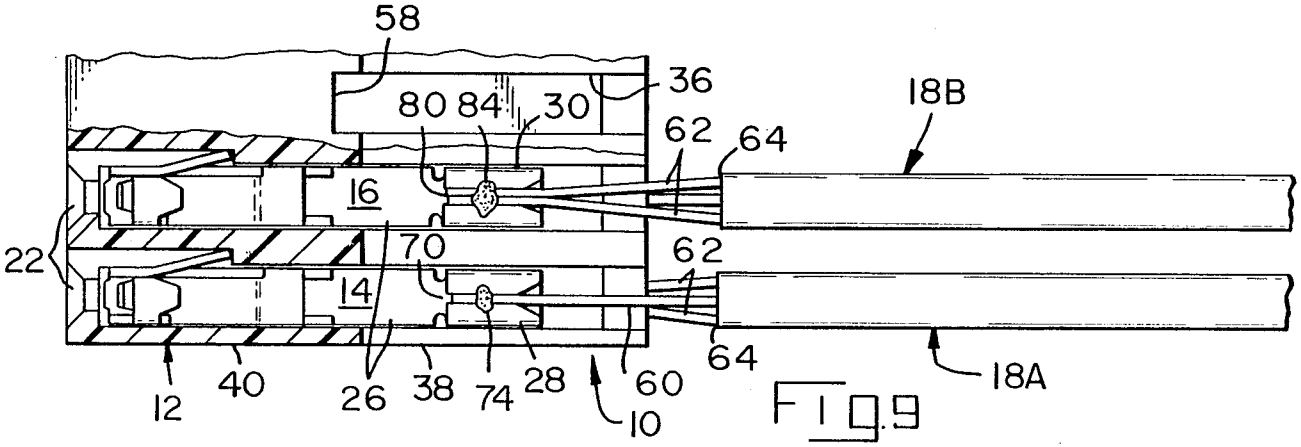
Figure 10:
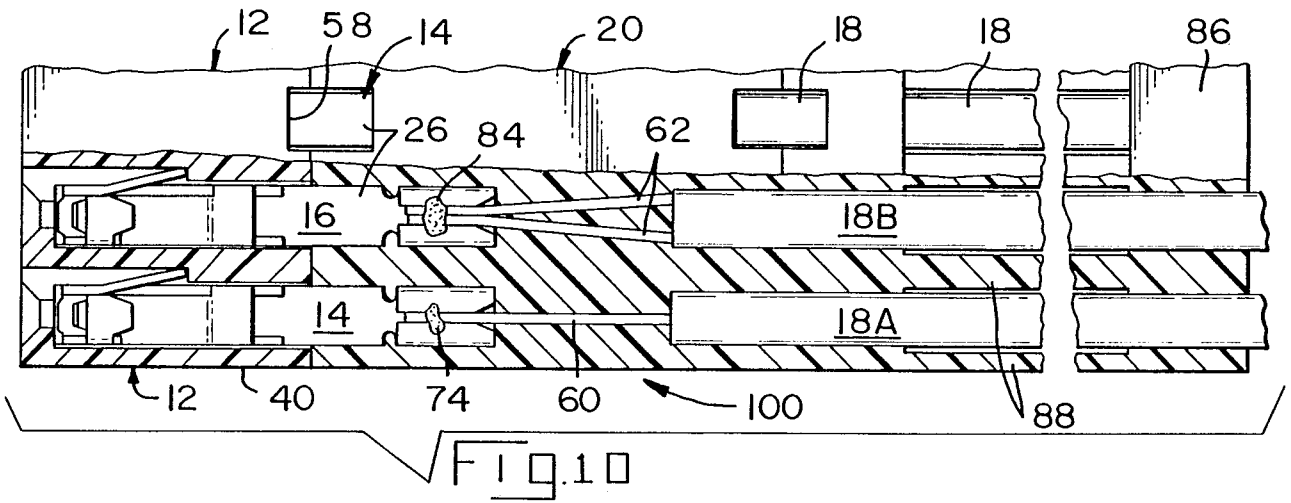

The terminal subassembly 10 is formed as shown in FIGS. 4 to 6. In FIG. 4 a signal terminal 14 has been secured in the upper passageway 22A to receive a signal conductor 60 of a cable 18 in conductor-connecting section 28 thereof, and a ground terminal 16 in the lower passageway 22B to receive both the ground conductors 62 of cable 18 in conductor-connecting section 30 thereof. The terminations of the conductors to the terminals is shown and described more particularly in U.S. Pat. No. 4,579,404 incorporated herein by reference. The signal conductor 60 is diverted relatively upward from a medial plane extending through contact-carrying portion 38 of housing 12 and cable 18, along a tapered surface 66 at the rearward end of a respective upper channel 36A and forwardly into a narrow slot 70 in conductor-connecting section 28 of signal terminal 14, as shown in FIGS. 5 and 9. Slot 70 preferably is narrower than the diameter of signal conductor 60 such that signal conductor 60 may be press fit thereinto and held in interference fit thereby prior to laser welding of the conductor to the terminal. Slot 70 is preferably formed by opposing spaced end surfaces 72 of stamped tabs extending laterally from sides of the terminal blank, whose free ends are bent around toward each other proximate the top surface of the blank during forming of the terminal. A length of the signal conductor is then held in interference fit proximate the top of slot 70 by slight spring action by and between opposing end surfaces 72, after being disposed along slot 70, and then is welded to conductor connecting section 28 by weld 74, as seen in FIGS. 9 and 10 regarding cable 18A. The top edges of slot 70 preferably are smoothed to facilitate receipt of the conductor thereinto, and a tapered lead-in 76 to slot 70 is also preferred.

Similarly and preferably simultaneously the pair of ground conductors 62 are diverted relatively downward from the medial plane and along a tapered surface 78 at a rearward end of lower channel 36B opposed from upper channel 36A. The pair of ground conductors 62 are brought together (best seen in FIGS. 8 to 10 regarding cable 18B) to extend forwardly and together are disposed along slit 80 of conductor-connecting section 30 of ground terminal 16. Slot 80 is dimensioned to be narrower than twice the diameter of a ground conductor, such that the pair of ground conductors 62 may be held in interference fit proximate the top of slot 80 by slight spring action by and between opposing spaced end surfaces 82 forming slot 80, as shown in FIGS. 5 and 9 and welded to conductor-connecting section 30 by weld 84.

The signal conductors and ground conductors are preferably laser welded to the respective conductor-receiving sections of the terminals. Laser welding is generally known and is discussed extensively in *Materials Processing Theory and Practices, Volume 3: Laser Materials Processing,* (edited by M. Bass, North-Holland Publishing Company, 1983) especially Chapter 3, "Laser Welding," J. Mazumder, pp. 113–200. In particular, laser welding in electronics is described in Electronics, Sept. 22, 1981 in an article by Henderson on pages 149–154 entitled "Dual Lasers Speed Termination of Flexible Printed Wiring."

Terminal subassembly 10 as shown in FIG. 5 is then placed in a mold 200, shown in phantom in FIG. 6, for the overmolding of cover means 20 therearound to form the electrical connector assembly 100. Mold 200 has core pins 202 at the relatively forward end of the mold cavity, and core pins 204 located near the rearward end of the main cavity portion 206. Forward core pins 202 enter rear recesses 58 in the upper and lower walls of housing 12 and engage planar body sections 26 of terminals 14, 16, holding them against bottom channel surfaces 34 during the overmolding process. Forward core pins 202 extend fully between the sides of recesses 58 and act to prevent insulative material from entering the receptacle contact sections 24 of terminals 14, 16. Rearward core pins 204 engage cables 18 from above and below, holding them in position during the overmolding process.

In FIG. 6, the major portion of contact-carrying portion 38 of housing 12 is disposed in main cavity portion 206, and also conductor-connecting sections 28, 30 of terminals 14, 16 and the terminations of conductors 60, 62 thereto, and insulated end portions of cables 18.

Insulative material such as preferably polypropylene is injected into the mold cavity and molded around the termination section of terminal subassembly 10, forming dielectric cover means 20 thereover rearwardly from contact-receiving portion 40 of housing 12. Cover means 20 seals the terminations of the conductors to the terminals, especially welds 74 and 84. Cover means 20 also firmly embeds the terminals and thereby prevents movement of the terminals in connector assembly 100. Cover means 20 also extends rearwardly along insulated portions of cables 18 providing strain relief therefor without deforming the cables such as occurs in conventional strain relief methods when the cables are clamped tightly or are bent around axially normal projections of housing members.

When individual cables are used, a second strain relief preferably is provided by a transverse bar 86 spaced rearwardly along the cables 18 from cover means 20 and joined integrally thereto by by axially extending webs 88, seen best in FIGS. 2 and 10. Webs 88 are located at ends of the row of cables 18 and preferably between at least several of the cables near the row ends and are formed by axial cavity portions (not shown), and transverse bar 86 is formed by rear cavity portion 208. Cables 18 interior of the end ones adjacent webs 88 are disposed in mold channels 210 which serve to maintain alignment thereof. Second strain relief bar 86 serves as a gripping feature during mating and unmating of connector assembly 100 to and from a pin array, thus relieving strain on the individual cables 18.

Figure 7:
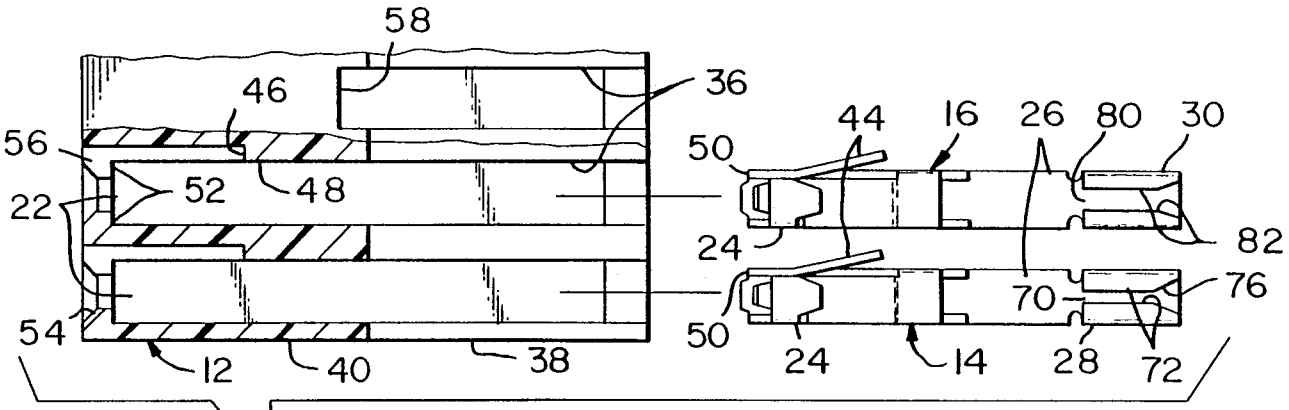
FIGS. 7 to 10 are part plan views of adjacent signal and ground terminals exploded from the housing, secured in the housing to receive signal and ground conductors, terminated to the respective conductors, and overmolded respectively, with the top of the housing broken away.
Figure 8:
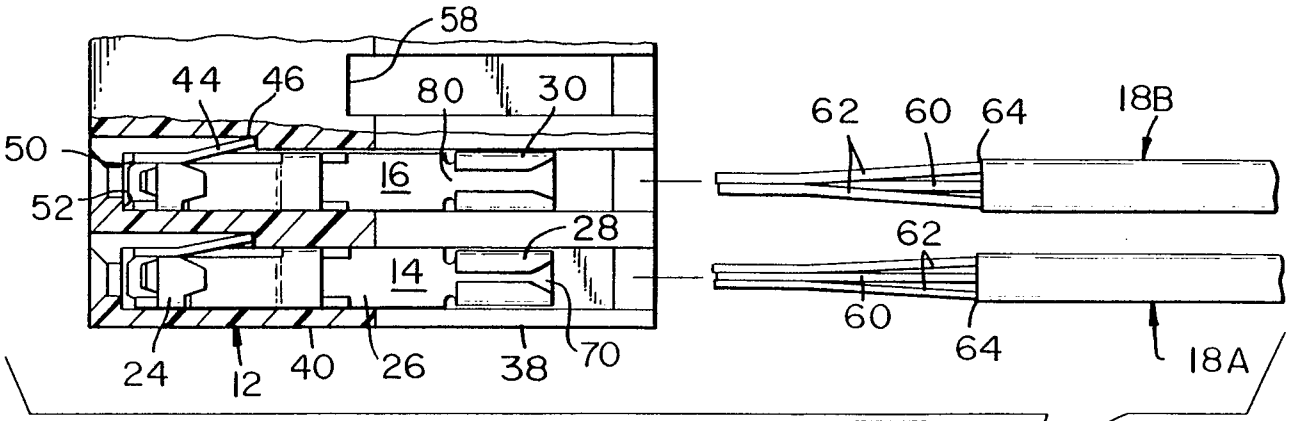

FIGS. 7 through 10 illustrate a top section view showing the assembly of connector assembly 100. In FIG. 7 a signal 14 and ground 16 terminal are inserted into respective adjacent passageways 22 and channels 36 of housing 12. In FIG. 8, signal terminal 14 is secured in passageway 22 by locking lance 44 against stop surface 46 and is about to receive a signal conductor 60 of end cable 18A; portions of ground conductors 62 are visible behind signal conductor 60. Ground terminal 16 is similarly secured in passageway 22 to receive a pair of ground conductors 62 of second cable 18B. In FIG. 9 signal conductor 60 of cable 18A is disposed in slot 70 and is welded at weld 74 to conductor-connecting section 28 of signal terminal 14; and ground conductors 62 of cable 18B are disposed in slot 80 and are welded at weld 84 to conductor-connecting section 30 of ground terminal 16 to form terminal subassembly 10.

In FIG. 10, terminal subassembly 10 has been overmolded with cover means 20 rearwardly from contact-receiving portion 40 of housing 12 to form connector assembly 100. Cover means 20 seals the terminations and end portions of cables 18A, 18B. Cover means 20 is also joined to transverse bar 86 by webs 88 extending along cables 18A, 18B. A portion of planar body section 26 of another signal terminal 14 is visible in the aperture formed by a core pin 202 of mold 200 rearwardly from rear recess 58 of housing 12; and a portion of a third cable 18 is visible in the aperture formed by a core pin 204 near the rearward end of cover means 20.

A connector assembly 100 of the present invention may also be terminated to the other ends of cables 18 to form a wire harness. Connector assembly 100 can be terminated to a variety of transmission cables including round individual cables, flat ribbon cable having a plurality of signal conductors and associated ground conductors, coaxial cables, and cables having only one ground conductor for each signal in which case the ground terminals 16 usable therewith should have slots formed to receive a single ground conductor. The present invention is also useful with tri-lead cables having an inner jacket around the signal conductor and a foil shield within the outer jacket and around the ground and insulated signal conductors.

A variety of features may be molded into or onto the outer surfaces of cover means 20. Receptacle contact sections 24 may have a different structure from that shown. Without departing from the spirit of the present invention or the scope of the claims, other variations may be devised in light of the teachings hereof.

What is claimed is:

1. A double row electrical connector for signal conductor means and ground conductor means of a plurality of electrical cables for use in transmitting electrical signals with high reliability and uniformity, comprising:

an electrical terminal subassembly including a dielectric housing member having a contact-receiving portion and a thin contact-carrying portion extending rearwardly from said contact-receiving portion and in the medial plane thereof, said contact-receiving portion having two parallel rows of opposed terminal-receiving passageways communicating with and extending rearwardly from a mating face of said housing member, a plurality of signal terminals and ground terminals each having a contact section, a body section rearwardly therefrom and a conductor-connecting section at a rearward end thereof, each said signal and ground terminal being secured by securing means in said housing member with said contact section being disposed in a respective said terminal-receiving passageway and said body section and said conductor-connecting section thereof being disposed along and against the surface of said contact-carrying portion, a said ground terminal being disposed in a respective said passageway opposed from each said signal terminal;

a plurality of electrical cables substantially disposed in said medial plane, each having a signal conductor and at least one ground conductor associated therewith, a plurality of stripped end portions of the signal conductors and ground conductors extending forwardly from said cables and along said contact-carrying portion of said housing member from a rearward end thereof and electrically connected to respective conductor-connecting sections of respective said signal and ground terminals, each said at least one ground conductor being terminated to a said ground terminal disposed on the opposite side of said contact-carrying portion from the signal terminal terminated to the associated said signal conductor;

a dielectric cover means molded and secured sealingly onto said electrical terminal subassembly rearwardly from said contact-receiving housing portion and onto and around conductor end portions sealing the terminations and holding the terminals immobile; and a transverse bar spaced rearwardly from said cover means and integrally joined thereto by axially extending web sections which are spaced from each other and extend along at least several said electrical cables, said bar being molded around and engaging insulated sections of said plurality of electrical cables spacing, supporting and providing non-distorting strain relief thereto;

said conductor-connecting section of each said signal and ground terminal including an axially extending slot disposed only an incremental distance from said surface of said thin contact-carrying portion to receive therealong a respective said signal conductor or said at least one ground conductor only a slight distance offset from the plane of said electrical cables minimizing distortion of said signal and ground conductors, and each said slot having a width slightly less than the diameter of a respective said signal conductor or said at least one ground conductor to hold same in interference fit therein until weld termination thereof;

all whereby said signal and ground conductors are substantially undeformed and unbent at and by the connector terminated thereto and the strain relief provided thereby, and the electrical performance characteristics of the electrical cables are maintained.

2. An electrical connector as set forth in claim 1 wherein said signal terminals and said ground terminals alternate in each said row, and each signal terminal in one said row is paired with an opposing ground terminal in the other said row, the signal terminal and ground terminal of each said pair being terminated respectively to a signal conductor and said at least one ground conductor associated with said signal conductor.

3. An electrical connector as set forth in claim 1 wherein said contact sections of said terminals are receptacle contact sections electrically engageable with pin contact sections of a pin array of a printed circuit board, said pin contact sections being receivable into said receptacle contact sections from said mating face of said housing member.

4. An electrical connector as set forth in claim 1 wherein one said ground conductor is associated with each said signal conductor, and said conductor-connecting section of each said ground terminal includes an axially extending conductor-receiving slot along which a respective ground conductor end portion is disposed and held in interference fit and then welded to said ground terminal forming a weld joint, said slot having a width slightly less than the diameter of said ground conductor.

5. An electrical connector as set forth in claim 1 wherein two said ground conductors are associated with each said signal conductor, and said conductor-connecting section of each said ground terminal includes an axially extending conductor-receiving slot along which end portions of each said two ground conductors are disposed and held in interference fit and then welded to said ground terminal forming a weld joint, said slot having a width slightly less than twice the diameter of a said ground conductor.

6. An electrical connector as set forth in claim 1 wherein channels extend axially along said contact-carrying housing portion rearwardly from respective terminal-receiving passageways in said contact-receiving housing portion, along which said channels are disposed body sections and conductor-connecting sections of respective said signal and ground terminals.

7. An electrical connector as set forth in claim 1 wherein said contact-carrying portion rearwardly of said conductor-connecting slots comprises gradually tapered surfaces along which are disposed portions of said signal and ground conductors extending forwardly from respective said electrical cables disposed in said medial plane whereby said conductors are diverted at only a slight angle from said plane to be terminated.

8. An electrical connector as set forth in claim 1 wherein said terminal securing means comprises locking lances of said terminals engaging cooperating stop surfaces in respective said terminal-receiving passageways.

9. A method of making an electrical connector having a housing member and pairs of opposing signal and ground terminals having contact sections securable in terminal-receiving passageways in a contact-receiving portion of said housing member, said signal and ground terminals each having a body section and a conductor-connecting section extending rearwardly along a contact-carrying portion of said housing member to be electrically connected to respective signal and ground conductor means of a respective one of a plurality of electrical cables, comprising the steps of:

securing said contact sections of said signal and ground terminals in respective said passageways of said contact-receiving housing portion;

electrically connecting said signal and ground conductor means to respective said conductor-connecting sections of respective said signal and ground terminals by welding, forming an electrical terminal subassembly;

placing said electrical terminal subassembly and end portions of said electrical cables, in a main cavity portion of a mold;

engaging and holding respective said body section of said terminals by first core pins of said mold against said contact-carrying portion and simultaneously closing rearward ends of the terminal-receiving passageways of said housing member thereby;

engaging and holding at least end portions of respective said cables by holding means in said mold such that portions of said cables located rearwardly from said housing member are disposed in a second cavity portion transverse to said cables, and such that said mold includes axial cavity portions along end ones of said cables and between at least several said cables and joining said main and said second cavity portions; and molding a dielectric cover means of said electrical connector by injecting moldable dielectric material into the cavity of said mold rearward from said first core pins and around said contact-carrying portion of said housing member, at least said conductor-connecting sections of said terminals, said signal and ground conductors and said end portions of said electrical cable means, forming said dielectric cover means rearwardly of said contact-receiving portion thereof, sealing the terminations and holding the terminals immobile, and forming a transverse bar across and around said electrical cables spaced rearwardly from said cover means and joined thereto by integral web sections spaced from each other thereby providing non-deforming cable strain relief.

10. A method as set forth in claim 9 wherein said cable holding means of said mold are second core pins.

11. A method as set forth in claim 9 wherein said electrical connecting step comprises laser welding said conductors to respective said terminals.

12. A method as set forth in claim 11 wherein said electrical connecting step further comprises disposing said conductors in interference fit in slots of said conductor-connecting terminal sections prior to said laser welding step.

* * * * *